US005820419A

United States Patent [19]

Liao

[11] Patent Number: 5,820,419

[45] Date of Patent: Oct. 13, 1998

[54] WATERPROOF SAFETY SOCKET STRUCTURE USED FOR MINIATURE LIGHT BULB

[76] Inventor: Nan-Whair Liao, No. 18, Tzu Yu Road., Hsinchu, Taiwan

[21] Appl. No.: 819,770

[22] Filed: Mar. 18, 1997

[51] Int. Cl.[6] ..... H01R 17/00

[52] U.S. Cl. ..... 439/699.2; 439/280

[58] Field of Search ..... 439/280, 616, 439/656, 699.2, 575

[56] References Cited

U.S. PATENT DOCUMENTS 5,372,525 12/1994 Wu et al. ..... 439/656
5,620,343 4/1997 Pan ..... 439/699.2
5,626,415 5/1997 Huang ..... 439/699.2
5,630,729 5/1997 Francis ..... 439/699.2
5,667,296 9/1997 Cheng et al. ..... 439/280
5,672,077 9/1997 Wang et al. ..... 439/616
5,685,638 11/1997 Huang ..... 439/280

*Primary Examiner*—Neil Abrams
*Assistant Examiner*—Brian J. Biggi
*Attorney, Agent, or Firm*—Rosenberg, Klein & Bilker

[57] ABSTRACT

The invention relates to a waterproof safety socket structure, which mainly employs a sleeve element, together with terminals housed inside, attached to the lower end of a light bulb holder and combined with a socket shell to form a tight joint preventing water penetration.

2 Claims, 13 Drawing Sheets

WATERPROOF SAFETY SOCKET STRUCTURE USED FOR MINIATURE LIGHT BULB

BACKGROUND OF THE INVENTION

A decorative light bulb series is often used outdoors and thus the waterproof efficiency is an important factor in design. At present most of conventional structures use tight-fit means to integrate a socket shell, a light bulb holder, and a light bulb to obtain a waterproof effect. However, because conductor wires need to pierce through the bottom of the socket to reach light bulbs, it needs to have openings made thereon. Such openings easily lead to water penetration and finally degrade the function of sockets.

In view of the above deficiencies, the primary object of the invention is to provide a waterproof safety structure of miniature light bulb sockets that employs an innovative coupling mechanism to overcome existing drawbacks in a conventional light bulb socket structure. Now the features and advantages of the invention will be detailed below with reference to the accompanying drawings.

BRIEF DESCRIPTION OF THE ACCOMPANYING DRAWINGS

Figure 3:
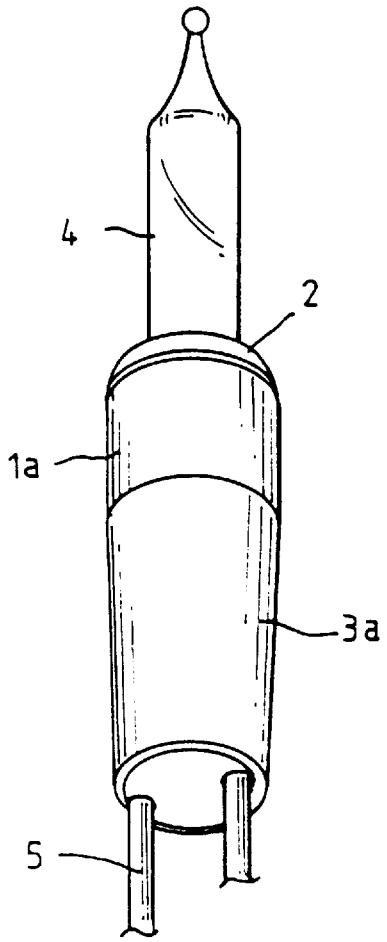

FIG. 3 perspectively shows another embodiment of a light bulb socket structure of the invention.

Figure 4:
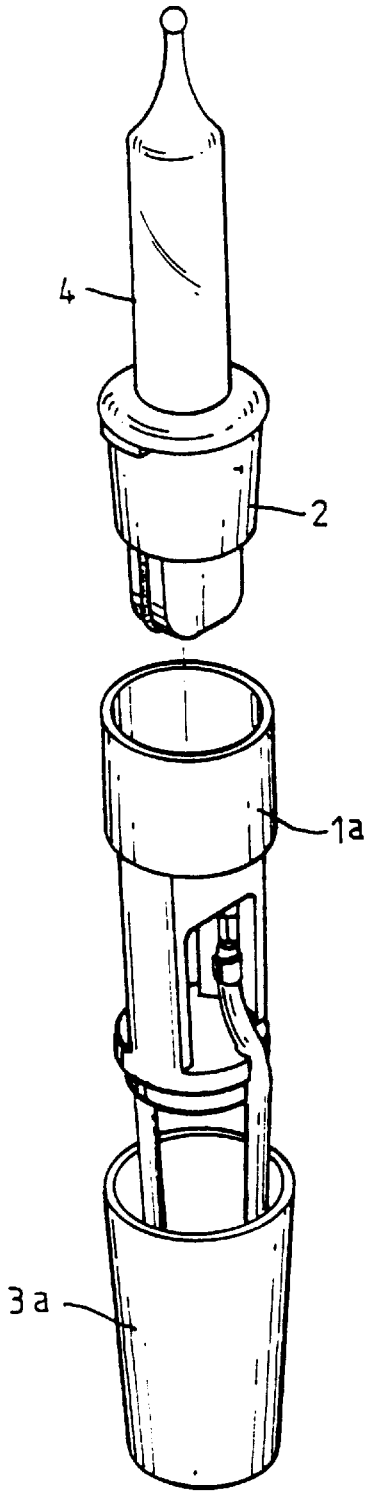

FIG. 4 is an exploded view of the light bulb socket structure of FIG. 3.

Figure 5:
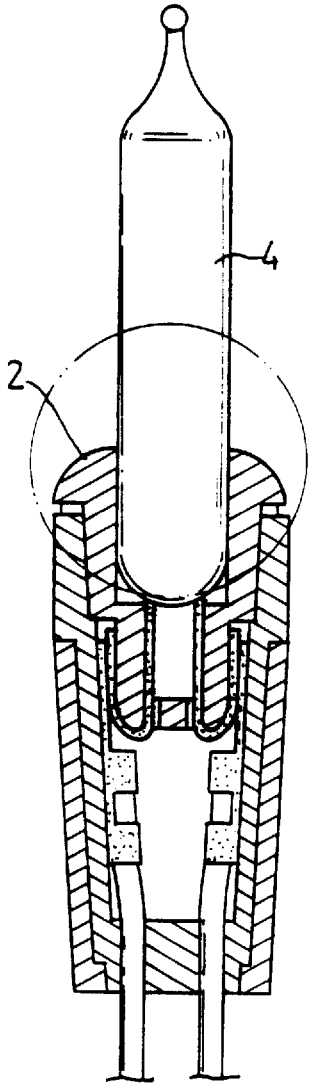

FIG. 5 is a cross-sectional view showing the socket of FIG. 3 in an assembled state.

Figure 6:
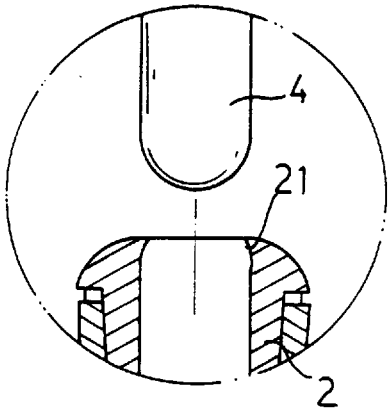

FIG. 6 is a partially cross-sectional view of the socket shown in FIG. 5.

Figure 7:
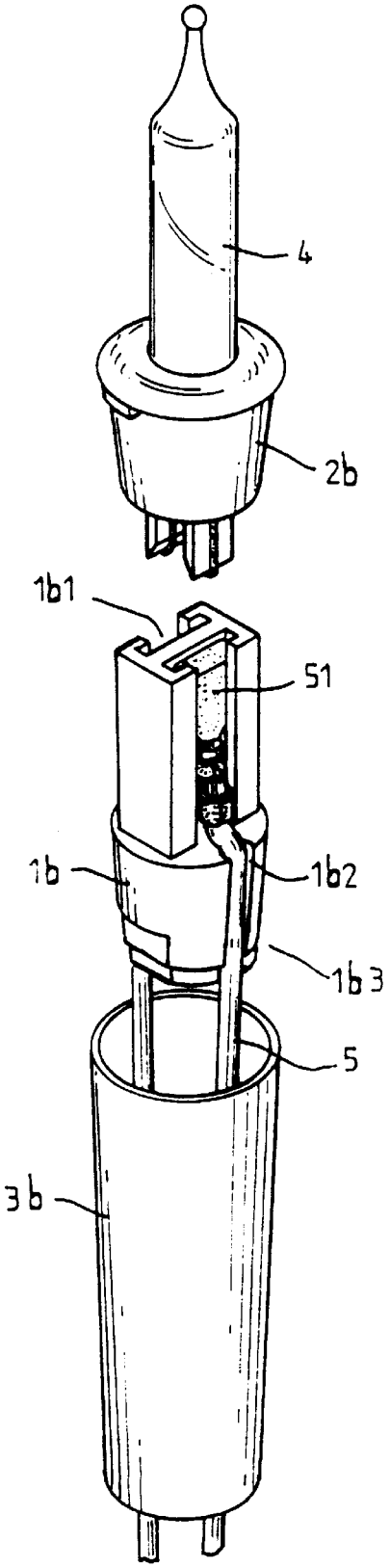

FIG. 7 is an exploded view of the third embodiment of a light bulb socket structure according to the invention.

Figure 8:
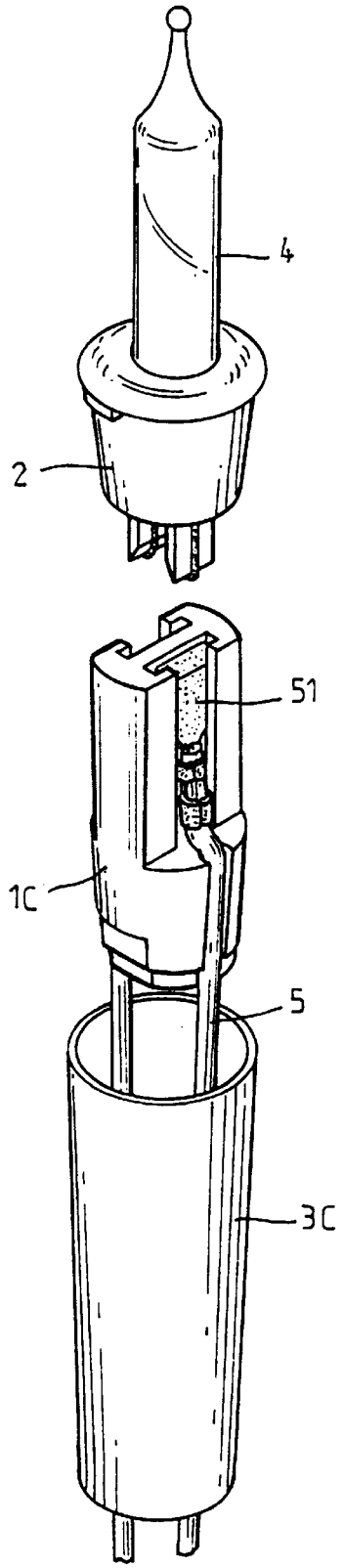

FIG. 8 is an exploded view of the fourth embodiment of a light bulb socket structure according to the invention.

Figure 9:
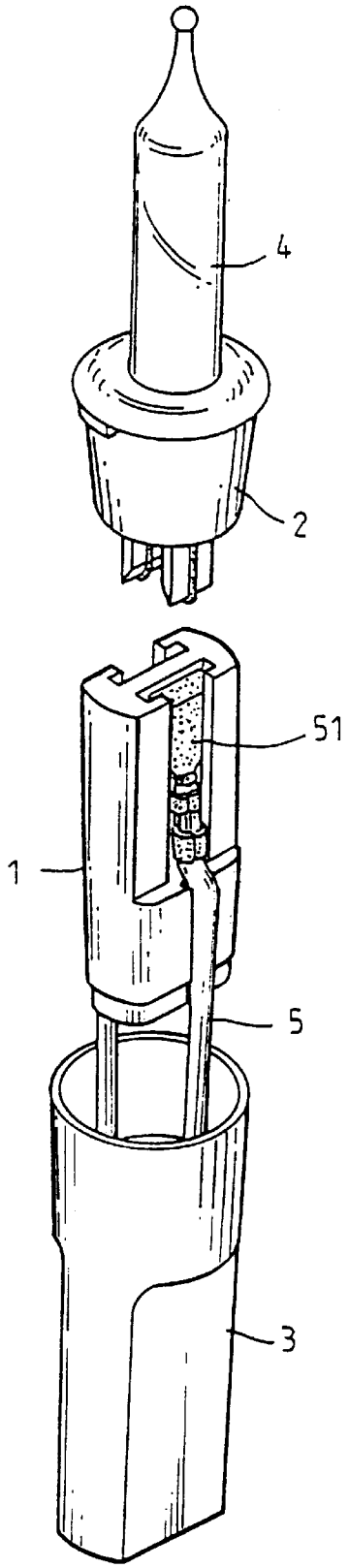

FIG. 9 is an exploded view of the fifth embodiment of a light bulb socket structure according to the invention.

Figure 10:
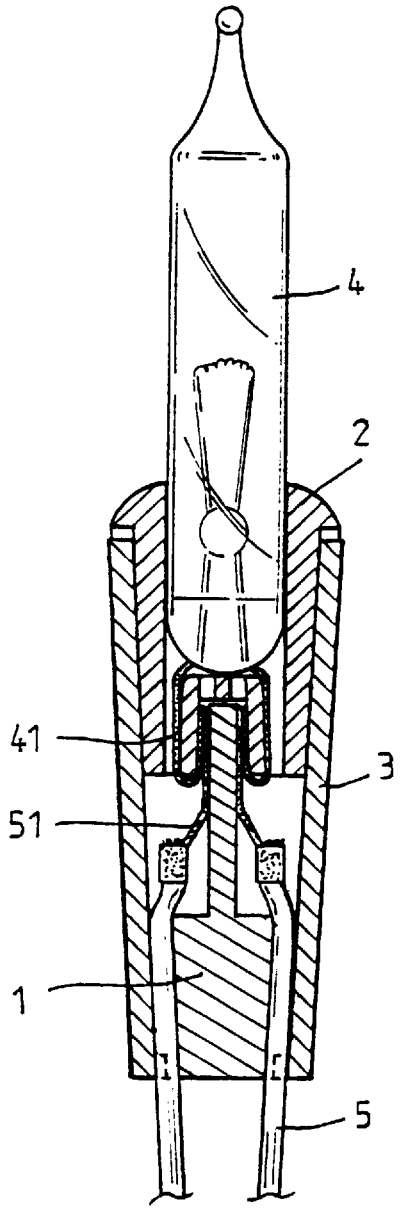

FIG. 10 is a cross sectional plan view showing a socket assembly of the invention.

Figure 11:
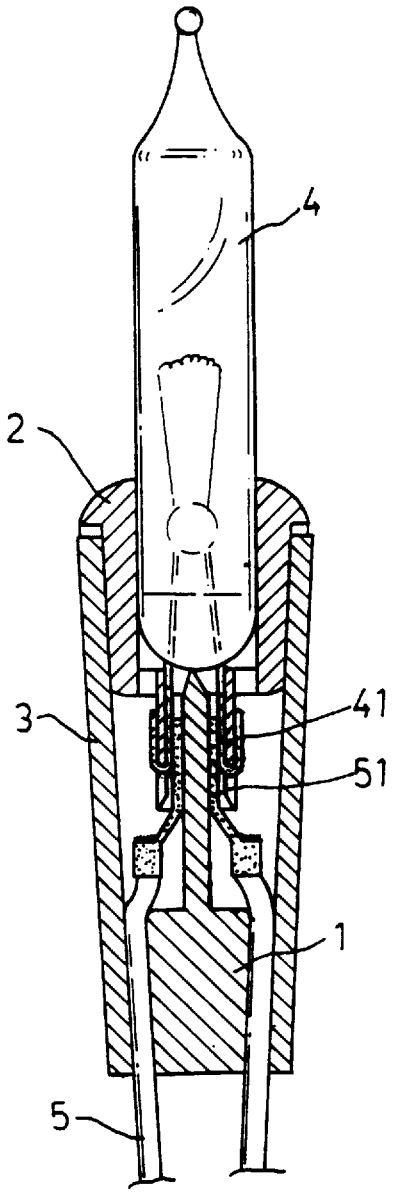

FIG. 11 is another cross-sectional plan view of a socket assembly of the invention.

Figure 12:
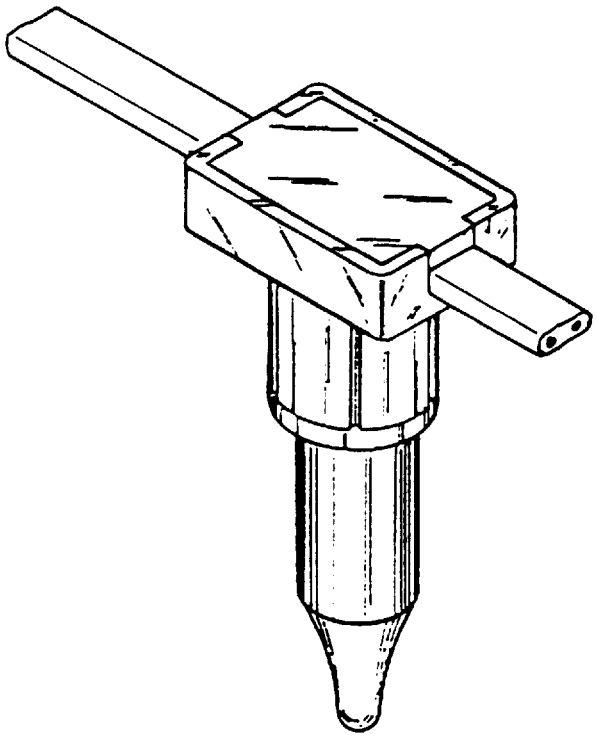

FIG. 12 perspectively shows a further embodiment of a light bulb socket structure of the invention.

Figure 13:
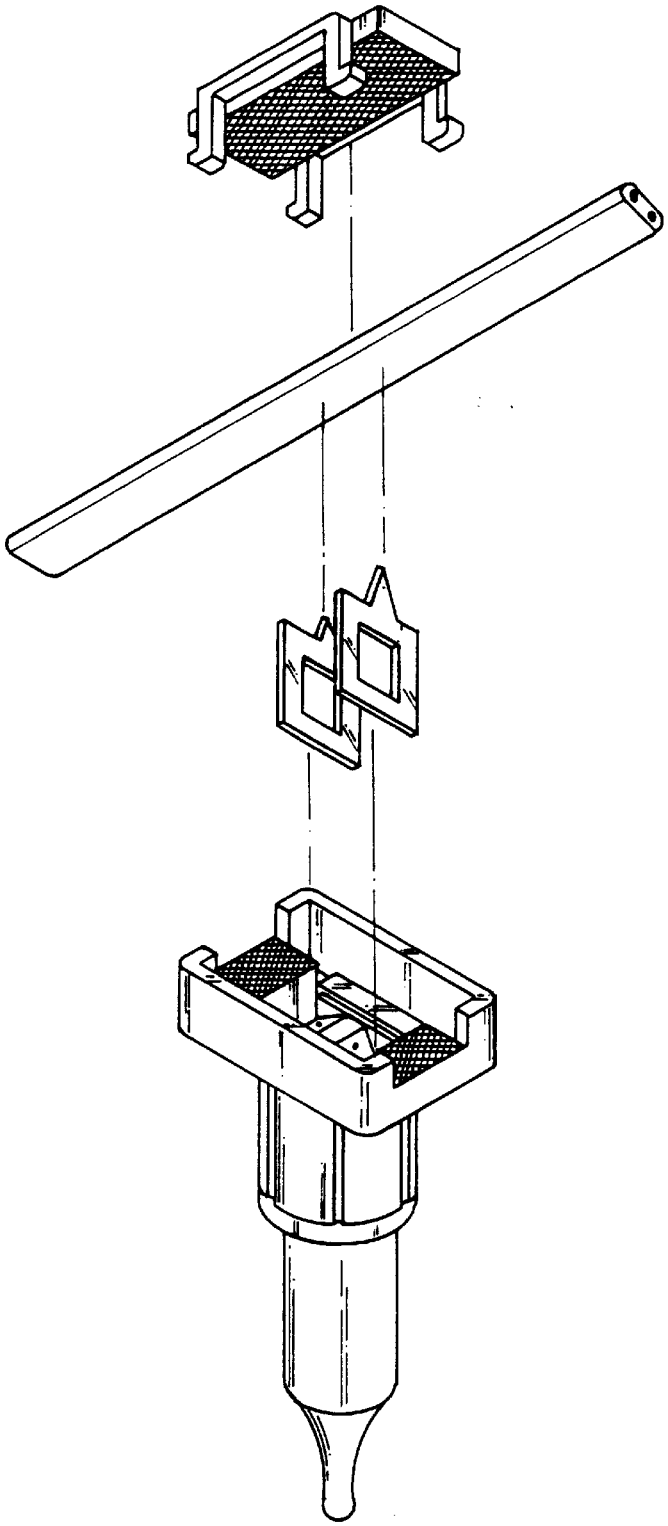

FIG. 13 is an exploded view of the embodiment of FIG. 12 of a light bulb socket structure according to the invention.

Figure 14:
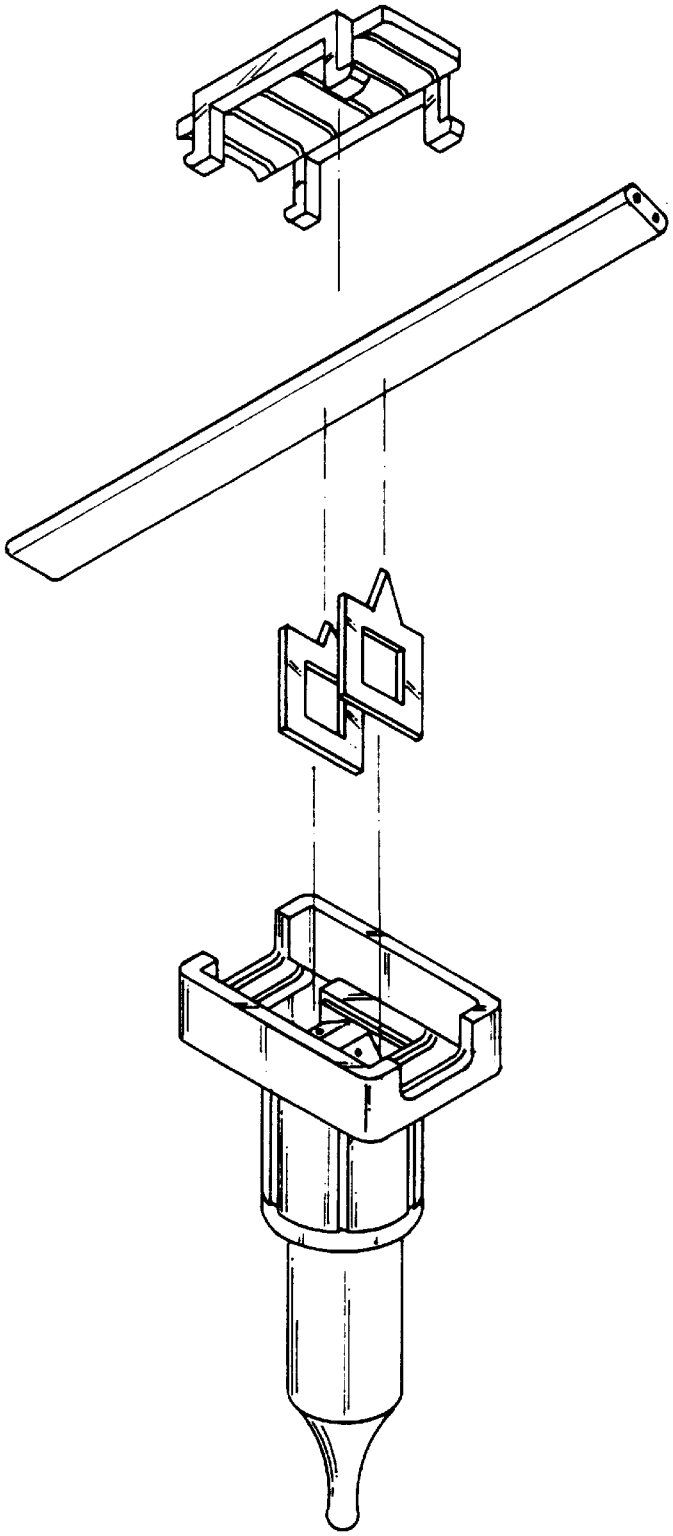

FIG. 14 is an exploded view of another embodiment of FIG. 12 of a light bulb socket structure according to the invention.

DETAILED DESCRIPTION OF PREFERRED EMBODIMENTS

Figure 1:
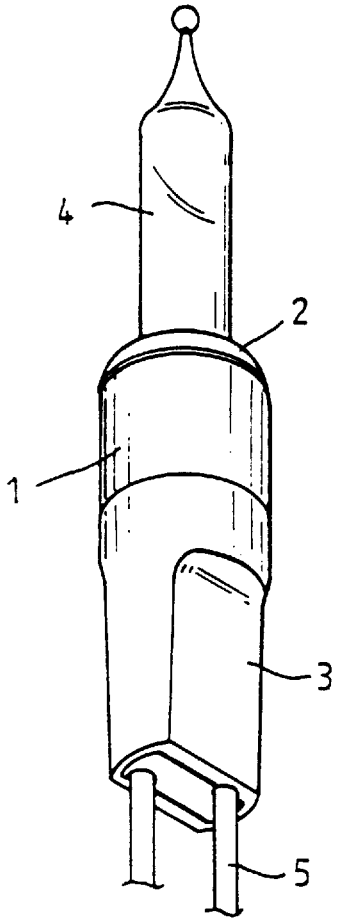
FIG. 1 is a perspective view showing the outer appearance of a light bulb socket structure according to the invention.
Figure 2:
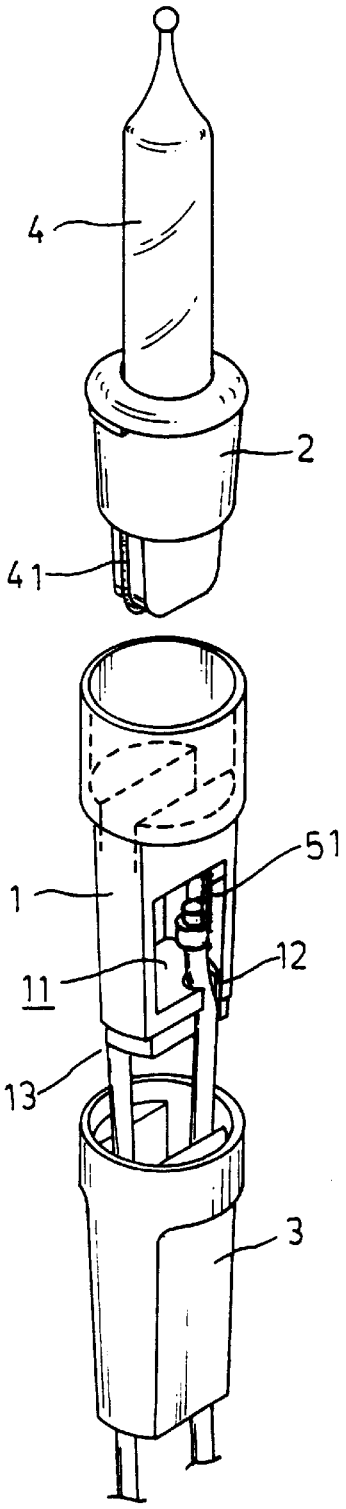
FIG. 2 is an exploded view of the light bulb socket structure shown in FIG. 1.

As shown in FIGS. 1 and 2, the invention includes a holder (2), a socket shell (3), a miniature light bulb (4), and is featured by a sleeve element (1). The sleeve element (1) has a cylindrical body at the upper portion thereof for snugly receiving the holder (2) and a flat segment at the lower portion, which segment can be tightly accommodated inside a socket shell (3). A miniature light bulb mounts on the holder (2), with two lead wires downwardly passing through the open end of the holder (2) and bent and flatly lying on the outer side surfaces of the holder (2). Formed on the flat segment of the sleeve element (1) is a through hole (11) and two round slots (12) accommodating conductor wires (5). The conductor wires further have terminals (51) extending into the interior of the sleeve element (1) to electrically connect with two lead wires (41) of the light bulb (4). The sleeve element (1) has such flanges (13) on its lower end that is designed to keep the sleeve element (1) firmly attached to the socket shell (3). Especially the conductor wires (5) are squeezed between the socket shell (3) and the sleeve element (1) to produce a waterproof effect. As a result, the inventive light bulb socket structure can get rid of a major drawback existing in a conventional one.

FIGS. 3 and 4 illustrate another embodiment of a cylindrical socket according to the invention, in which the sleeve element is configured to have a round lower end in order to tightly engage with a cylindrical socket shell **(3*a*)**.

Another feature of the invention is a light bulb holder (2). As can be seen from FIGS. 5 and 6, the holder (2) has an inwardly extending periphery (21) by which the sleeve element can effectively grasp a light bulb to prevent water penetration.

Now referring to FIG. 7, in which a variation of a light bulb socket according to the invention is shown, the sleeve element **(1*b*) is configured to have two engagement grooves (1*b*1) on the upper portion, a cylindrical body with round grooves (1*b*2) on the lower portion, and flanges (1*b*3) at the lower end. The conductor wires route through the round grooves (1*b*2) with terminals (51) situated inside the engagement grooves (1*b*1). The sleeve element (1*b*) together with the above arrangement is further placed into the socket shell (3*b*). The light bulb holder (2*b*) has at the lower end two flat plates (2*b*1) round which the lead wires (41) of a miniature light bulb (4) wind. When the holder (2*b*) mounts on the top of the socket shell (3*b*), two lead wires (41) are individually in contact with two terminals (51) to form an electrical connection. Sleeve elements of such a design have also an equivalent waterproof effect. FIG. 8 shows a variation of a sleeve element (1*c*) that can completely be fit for the configuration of a round socket shell (3*c*). FIG. 9 depicts a further variation of a sleeve element, which has two symmetrical flat side surfaces. FIG. 10 illustrates the embodiment shown in FIG. 9 in an assembled state. In the variation shown in FIG. 10, conductor wires are bent inwardly and the variation can be further altered into a form shown in FIG. 11, in which the conductor wires are bent outwardly. FIG. 12 shows a further embodiment in accordance with this invention that includes a different type of bulb holder and a cap engaging with each other to firmly connect with a flat-type electrical wire therebetween. FIGS. 13 and 14** show two embodiments which have different contacting inner surfaces of the holder and the cap. These and other variations are to be included into the scope of the invention.

What is claimed is:

1. A waterproof safety socket structure for miniature light bulbs, comprising:

a miniature light bulb having a pair of leads extending from one end thereof;

a bulb holder having a first bore extending longitudinally from an open first end thereof for receiving at least a portion of said miniature light bulb therein, said pair of leads passing through said bulb holder and being disposed adjacent an external surface of a second end thereof;

a longitudinally extended sleeve having a second bore extending longitudinally from an open first end thereof to a closed second end, said second bore being dimensioned to tightly receive said second end of said bulb holder therein, said sleeve having an opening extending transversely therethrough in open communication with said second bore and a pair of slots respectively extending from said opening to said second end of said sleeve on opposing sides thereof, said sleeve having a flange formed on an external surface thereof adjacent said second end of said sleeve;

a socket shell having a third bore extending longitudinally therethrough for receiving a portion of said sleeve therein; and, a pair of wires for electrical coupling with said pair of leads, each of said pair of wires having an electrical terminal coupled to an end thereof, each said terminal being inserted into said second bore through said opening with the respective wire extending through a respective one of said slots for sealing engagement between said sleeve and said socket shell, said flange of said sleeve being disposed in engaging relationship with said socket shell.

2. The waterproof safety socket structure as recited in claim 1 where said bulb holder second end has a pair of flat plates extending therefrom for respectively receiving said pair of leads thereon, said second bore of said sleeve being subdivided to form a pair of engagement grooves for respectively receiving said pair of flat plates therein, said electrical terminals being respectively disposed within said pair of engagement grooves.

* * * * *